US005404646A

United States Patent [19]

Naifeh

[11] Patent Number: 5,404,646

[45] Date of Patent: Apr. 11, 1995

[54] LEVER LOCKING KNIFE WITH REVERSING BLADE

[76] Inventor: Woodrow W. Naifeh, Rte. 13, Box 380, Tulsa, Okla. 74107

[21] Appl. No.: 163,072

[22] Filed: Dec. 6, 1993

[51] Int. Cl.[6] ..... B26B 5/00

[52] U.S. Cl. ..... 30/163; 30/164; 30/339

[58] Field of Search ..... 30/151, 153, 162, 163, 30/164, 329, 335, 337, 339

[56] References Cited

U.S. PATENT DOCUMENTS

| | | | |
|---|---|---|---|
| 255,847 | 4/1882 | Fiske | 30/163 |
| 515,743 | 3/1894 | Von Bultzingslowen | 30/163 |
| 576,648 | 2/1897 | Autenrieth | 30/151 |
| 1,370,995 | 3/1921 | Prince | 30/151 |
| 1,869,586 | 8/1932 | Seaholm | 30/337 |
| 2,260,141 | 10/1941 | Hanle | 30/163 |
| 2,721,340 | 10/1955 | Shultz | 7/8.1 |
| 3,900,950 | 8/1975 | Collins | 30/337 |
| 4,169,312 | 10/1979 | Mar | 30/337 |
| 4,354,313 | 10/1982 | Naifeh | 30/161 |
| 4,425,709 | 1/1984 | Quenzi | 30/151 |
| 4,606,123 | 8/1986 | Wrench | 30/153 |

FOREIGN PATENT DOCUMENTS

| | | | |
|---|---|---|---|
| 327051 | 6/1903 | France | 30/162 |
| 240786 | 2/1911 | Germany | 30/337 |
| 15028 | of 1895 | United Kingdom | 30/163 |

*Primary Examiner*—Richard K. Seidel
*Assistant Examiner*—Raymond D. Woods
*Attorney, Agent, or Firm*—Head & Johnson

[57] ABSTRACT

A lever locking knife with reversing blade having a handle with a slotted recess therein for removably receiving the blade, the handle having a lever pivoted from it, now the blade having a notch that receives a portion of the lever when the lever is in the closed position to hold the blade either in the extended, usable position, or received within the handle recess.

9 Claims, 2 Drawing Sheets

LEVER LOCKING KNIFE WITH REVERSING BLADE

CROSS REFERENCE TO RELATED APPLICATIONS

This application is not related to any co-pending patent application.

BACKGROUND OF THE INVENTION

1. Field of the Invention

This invention relates to a knife of the type having a handle and a separate blade, the handle having a recess for receiving either the forward cutting portion of the blade or the rearward, stub end of the blade and means for removably locking the blade so that the forward cutting portion is either exposed when the knife is in use or is received within the interior of the handle when the knife is in the closed position.

2. Description of the Prior Art

Conventional knives typically have a handle and a blade. In the most common type of knife, such as for use in a kitchen for meat or food processing or the like, the handle is affixed to the blade, that is, the handle does not move with respect to the blade. A second basic type of knife, sometimes referred to as a pocket knife, has a handle with a blade pivotally attached to it. This type of knife typically has a handle with a slot for receiving the blade therein when the knife is in the closed position and a mechanism for releasably supporting the blade in an extended position when the knife is in condition to be used. An example of a folding blade knife is U.S. Pat. No. 4,354,313 entitled "Slide Lock Folding Blade Knife" that issued on Oct. 19, 1982.

The present invention relates to a type of knife having a handle and blade which are separate components. The blade can be secured to the handle with the cutting portion of the blade exposed so that the knife can be used in the normal manner with the user holding on to the handle and the blade extending therefrom for cutting purposes. When the knife is to be placed in the stored position the blade is released from the handle and the cutting portion is inserted into the handle and the blade locked in the closed position so that the cutting portion of the blade is securely concealed within the handle. Others have provided knives with separate blades and handles that are removable with respect to each other as is illustrated in the following previously issued United States Patents:

| U.S. Pat. No. | Title | Inventor | Issue Date | Class |
|---|---|---|---|---|
| 576,648 | Surgeon's Knife | W. Autenrieth | 02/09/1897 | |
| 1,370,995 | Jack Knife | B. A. Prince | 03/08/21 | |
| 2,721,340 | Sheathed Tool With Latching Means | F. R. Shultz | 02/12/53 | 7/8.1 |
| 4,169,312 | Knife With Interchangeable Blades | Alfred C. Mar | 10/02/79 | B26B 1/00 |
| 4,425,709 | Pocket Tool | Phil Quenzi | 01/17/84 | B26B 5/00 |
| 4,606,123 | Cutlery Apparatus With Interchangeable Cutting Tool | Robert A. Wrench | 08/19/86 | B26B 1/04 |

One problem with knives formed of a handle and a separate blade that is removably attachable to the handle is that of securely retaining the blade with the handle either when the blade is secured in the manner wherein the knife is to be used for cutting purposes or wherein the blade is retained within the handle. The present invention provides a lever pivotally attached to the handle for locking the blade in reversing positions, either in the operating position or in the closed position. Most particularly, the present invention is distinguished over the prior art by the mechanism that removably retains the blade to the handle in reversible positions of the blade in an easy to use and yet secure manner that reduces the possibility of the blade becoming inadvertently dislodged from the handle.

SUMMARY OF THE INVENTION

This invention provides a lever locking knife with a reversing blade having a handle with a forward end and a rearward end. The handle has an opening communicating with the forward end.

An elongated blade has a forward cutting end portion and a rearward stub end portion. The blade has opposed edges, at least one of the edges being sharp in the forward end portion. One edge of the blade has a notch formed therein adjacent the blade rearward stub end.

The blade is positionable in two ways with respect to the handle. In the knife operating position the stub end portion of the blade is received within the handle opening. In the knife closed position, the blade forward end portion is received within the handle. In either position the notch that is formed in one of the blade edges is positioned within the handle opening.

A lever has a forward end pivotally affixed to the handle adjacent the handle forward end. The lever has a protruding portion extending within the handle opening when the lever is pivoted to a locked position. The protruding portion of the lever is receivable within the notch in the blade in either of the blade's position, that is, when the blade is in the operating position and or in the stored position. Thus, the lever retains the blade either in the operating or stored position.

A retainer is pivotally affixed to the handle adjacent the rearward end to retain the lever in the locked position.

A handle can be used with a variety of blade lengths and styles, however, when a blade is to be retained within the handle in the stored position the blade must have a length such that the forward cutting portion is less than that of the handle.

A better understanding of the invention will be obtained from the following description of the preferred embodiment, taken in conjunction with the attached drawings.

BRIEF DESCRIPTION OF THE DRAWINGS

FIG. 3 shows the blade affixed to the handle in the operating position, the blade extending from the handle so that it can be used for cutting operations.

FIG. 4 shows the attitude of the knife as it would be used such as for a pocket knife or for a knife of larger dimensions than that which would normally be acceptable as a pocket knife but in which the sharp portion of the blade is fully retained within the handle.

DESCRIPTION OF THE PREFERRED EMBODIMENTS

Figure 6:
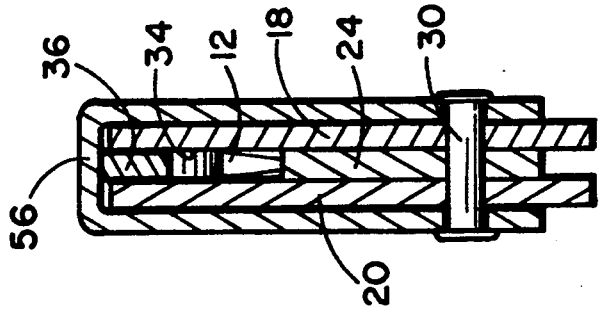
FIG. 6 is a cross-sectional view taken along the line 6—6 of FIG. 4 showing the blade in the stored position, the lever in the locked position and the retainer in the closed position.

The lever locking knife of this disclosure consists of two basic components, that is, a handle generally indicated by the numeral 10 and a blade generally indicated by the numeral 12. The handle 10 has a forward end 14 and a rearward end 16. Handle 10 is formed of two opposed plates, as shown in the cross-sectional views of FIGS. 5 and 6, that is, a first handle plate 18 and a second handle plate 20. Positioned between handle plates 18 and 20 is a forward spacer 22 and a rearward spacer 24. Forward spacer 22 is retained in position between plates 18 and 20 by a rivet 26 and pins 28. In like manner, rearward spacer 24 is retained between the plates by a rivet 30. Rearward spacer 24 is preferably elongated as illustrated to extend beyond the handle rearward end 16 and to have a hole 32 therethrough providing means whereby a string, leather cord or the like may be received. This permits a users to attach the knife to a belt loop or otherwise secure the knife in a way so as to prevent the possibility of it being lost.

Spacers 22 and 24 provide a space 34 between handle plates 18 and 20.

Pivotally received within space 34 is a lever 36. More particularly, lever 36 has a forward end 38 and a rearward end 40. By means of a rivet 42 adjacent forward end 38, lever 36 is pivoted between handle plates 18 and 20 and within space 34. Lever 36 is pivotal between a locked position as shown in FIG. 3 and an unlocked position as shown in FIG. 1.

Figures 1, 2, 3:
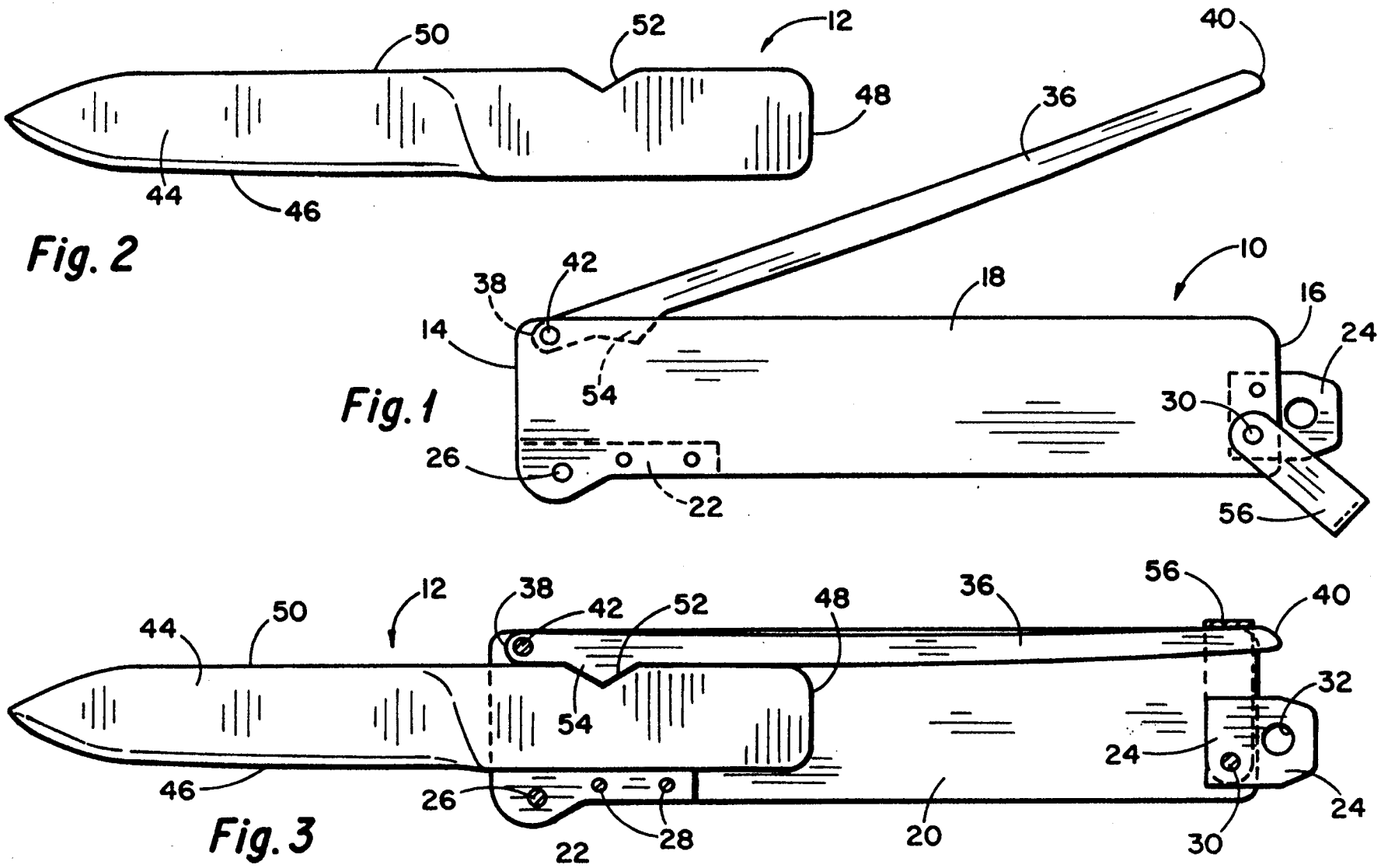
FIG. 1 is an elevational view of the handle that is used in forming the lever locking knife of this invention. The handle has a lever which is shown in the raised position indicating the attitude of the lever when a blade is being affixed to or removed from the handle.
FIG. 2 is an elevational side view of a blade that can be employed with the handle of FIG. 1.
FIG. 3 is an elevational view of the blade of FIG. 2 affixed to the handle of FIG. 1 shown without one of the handle plates so as to reveal the interior portions of the handle. The lever in FIG. 3 is in the locked position and the lever retainer is in the retained position.

Blade 12 as seen best in FIGS. 2 and 3 has a forward cutting end portion 44 having a cutting edge 46 and a rearward stub end 48. Blade 12 has an edge 50 that is opposite to cutting edge 46. Edge 50 is normally blunt but could be a sharp edge as is edge 46 if it is desirable to have a blade with two opposed sharp edges. Formed in edge 50 adjacent rearward stub end 48 is a V-shaped notch 52.

Figure 4:
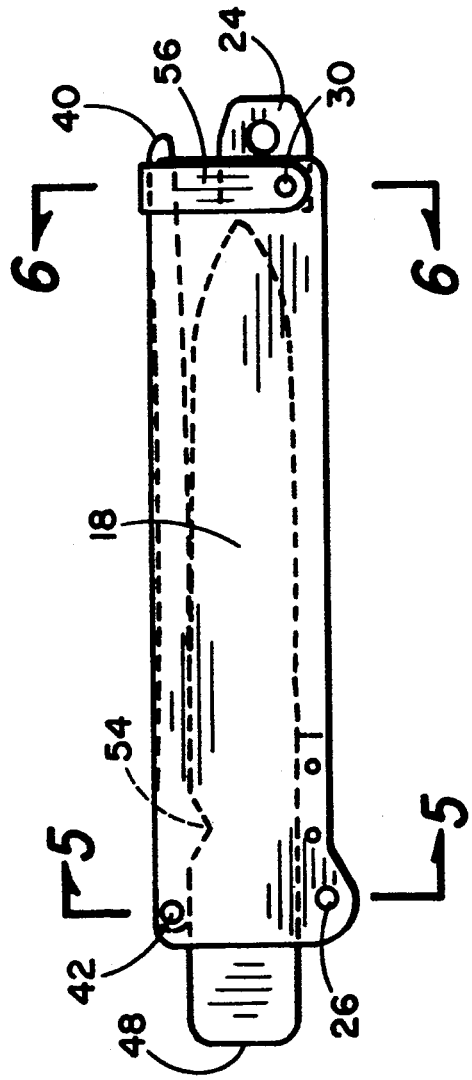
FIG. 4 is an elevational side view of the handle of FIG. 1 and blade of FIG. 2 with the blade in the stored position and with the lever in the locked position.
Figure 7:
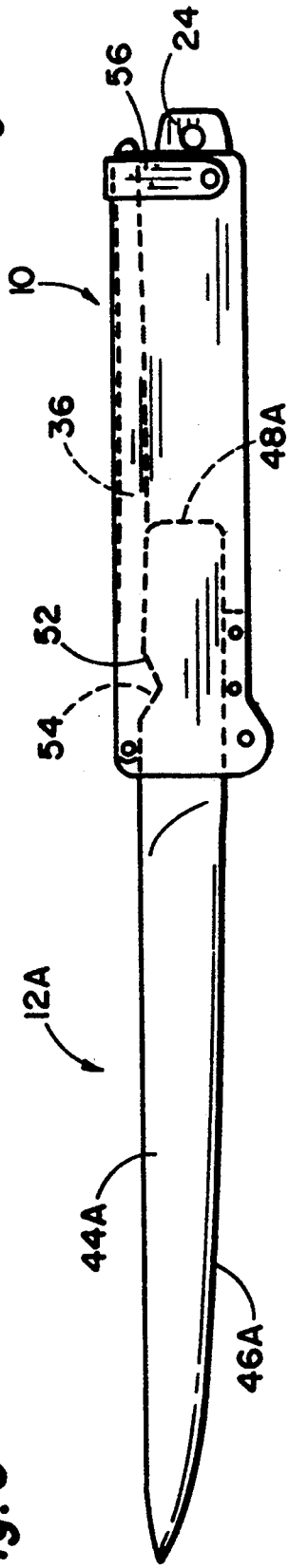
FIG. 7 is an elevational view of a handle as shown in FIGS. 1, 3 and 4 but with a longer blade illustrating that the handle may be used with a variety of blades. The long blade of FIG. 7 cannot be retained within the handle in a stored position.

Lever 36, as shown in FIGS. 1, 3, 4 and 7 has an integral protruding portion 54 that is shaped and dimensioned to be received within notch 52 in the knife blade. Lever 36 is pivotal between two positions, an open position as shown in FIG. 1 and a closed position as shown in FIGS. 3, 4 and 7. In the opened position a blade can be inserted or removed from the handle. This can be accomplished with the blade forward cutting end portion 44 extending away from or received within the handle. When the blade is in position so that notch 52 is in a line with lever protrusion 54, the lever may be moved to the locked position as shown in FIGS. 3, 4 and 7. In the locked position, the lever is held in contact with blade 12 and protrusion 54 extending within notch 52 prevents the blade from moving laterally with respect to the handle.

To keep the lever 36 in the locked position a retainer bail 56 is employed. The retainer bail is of a U-shaped construction and is secured to handle 10 by means of rivet 30. The retainer bail pivots around rivet 30. When in the position as shown in FIGS. 3 and 7, the lever is prevented from moving out of the locked position until the user slips the bail rearwardly. In the optimum configuration there is bending tension tending to move rearward end 40 of lever 36 away from the handle. This bending tension caused by slight flexing of the slender elongated lever 36 when the rearward end 40 thereof is depressed to receive retainer bail 56 serves to keep the retainer bail in position so that it cannot be easily and unintentionally moved away from the locked position.

FIG. 7 shows a knife formed of handle portion 10 and blade portion 12A. Blade portion 12A is essentially the same as blade 12 as shown in FIGS. 2, 3 and 4 except that it is longer. Specifically, blade 12A has a rearward stub end 48A and a forward cutting end portion 44A. The only difference being that the length of the blade is such that the forward cutting end portion 44A cannot be inserted into the interior of handle 10 since the length of the handle is too short with respect to the blade. The arrangement of FIG. 7 illustrates that a plurality of different size blades may be supplied with one handle 10 in a kit arrangement.

Figure 5:
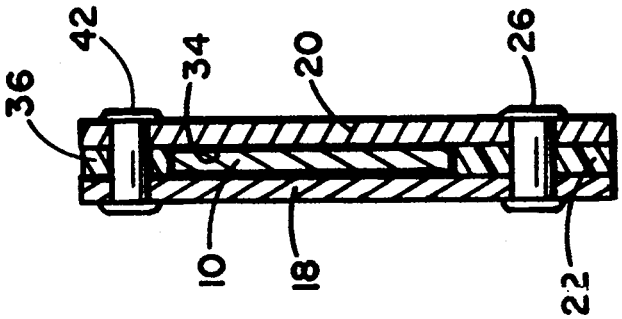
FIG. 5 is a cross-sectional view taken along the line 5—5 of FIG. 4 showing the relationship of the handle, blade and lever with the blade in the stored position and the lever in the locked position.

When blade 12 is inserted into the space 34 between handle plates 18 and 20 cutting edge 46 may rub against spacer 22. Therefore spacer 22 is preferably non-metallic, that is, formed of plastic, as illustrated in FIG. 5 so that the cutting edge surface 46 is not dulled as the blade is moved into or out of the stored position.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A knife comprising:

a handle having a forward end and a rearward end and having an opening therein communicating with said forward end;

an elongated blade having a forward cutting end portion and a rearward stub end portion and having opposed edges, one edge being a cutting edge, and having a v-shaped notch formed in one of said edges adjacent said rearward stub end portion, the blade rearward stub end portion having said notch therein being removably receivable within said handle opening;

a lever having a forward end pivotally affixed to said handle adjacent said handle forward end and having a protruding v-shaped portion extending within said handle opening when said lever is pivoted to a locked position, said protruding v-shaped portion being receivable within said v-shaped notch in said blade when said blade rearward stub end portion having said v-shaped notch therein is received within said handle opening to retain said blade fixed with respect to said handle, said blade being slidably positionable within said opening in said handle such that when said protruding v-shaped portion enters said v-shaped notch said blade is slidable as necessary either in a forward and a rearward direction so that said v-shaped notch aligns with said v-shaped projection as said lever is pivoted to said locked position; and a retainer engagable with said lever to releasably retain said lever in said locked position.

2. A knife according to claim 1 wherein said retainer is bail shaped and is pivotally secured to said handle adjacent said rearward end thereof.

3. A knife according to claim 2 wherein said lever, when in a closed position against said blade when said blade is received within said handle opening, is under bending tension whereby said retainer is maintained in engagement with said lever due to said lever bending tension.

4. A knife according to claim 1 wherein said handle is formed of opposed and paralleled side plates and including a forward space adjacent said handle forward end and a rearward spacer adjacent said handle rearward end and providing a space between said plates forming said opening in said handle.

5. A knife according to claim 4 wherein said lever is elongated and said lever forward end is pivotally received in said opening between said side plates and said blade is substantially retained in said opening between said side plates when said blade is in said locked position.

6. A knife according to claim 5 wherein said lever has a rearward end that extends slightly beyond said handle rearward end when said lever is in said locked position.

7. A knife according to claim 4 wherein said handle is made essentially of metal and said spacer adjacent said handle forward end is non-metallic.

8. A knife according to claim 4 wherein said handle has a height and wherein said spacer adjacent said handle rearward end extends in part exteriorly of said handle rearward end, said rearward spacer being of height less than the height of said handle whereby said lever extends contiguous to said spacer when said lever is closed within said handle and at least substantially between said opposed paralleled side plates.

9. A knife according to claim 1 wherein said blade is retainable by said handle in a first operating position wherein said rearward stub end portion is received within said handle and in a second, non-operating position wherein said blade forward cutting end portion is received within said handle, said lever protruding portion being positionable in said notch in both said blade operating and non-operating positions.

* * * * *